US009249622B1

(12) United States Patent
Kelley

(10) Patent No.: US 9,249,622 B1
(45) Date of Patent: Feb. 2, 2016

(54) GARAGE DOOR TRACK WITH INWARDLY HEMMED SIDEWALL, AND REINFORCING RIBS TO REDUCE THE INCIDENCE OF ROLLOUT

(71) Applicant: Robert A. Kelley, Moreno Valley, CA (US)

(72) Inventor: Robert A. Kelley, Moreno Valley, CA (US)

(73) Assignee: Premium Garage Door Hardware Inc., Mission Viejo, CA (US)

( * ) Notice: Subject to any disclaimer, the term of this patent is extended or adjusted under 35 U.S.C. 154(b) by 3 days.

(21) Appl. No.: 14/031,017

(22) Filed: Sep. 18, 2013

(51) Int. Cl.

| | |
|---|---|
| ***E05D 15/00*** | (2006.01) |
| ***E06B 9/58*** | (2006.01) |
| ***E06B 3/32*** | (2006.01) |
| *E04C 3/04* | (2006.01) |

(52) U.S. Cl.
CPC ... *E06B 9/58* (2013.01); *E06B 3/32* (2013.01); *E04C 2003/0404* (2013.01); *E04C 2003/0408* (2013.01); *E05Y 2201/684* (2013.01); *E05Y 2900/106* (2013.01)

(58) Field of Classification Search
CPC ..... E04C 2003/0404; E04C 2003/0408; E04C 2003/0413; E04C 2003/0443; E04C 2003/0465; E04C 2003/0473; E04C 3/00; E04C 3/02; E04C 3/07; E04C 3/09; E05Y 2900/106; E05Y 2201/684; E06B 3/485; E05D 15/16
USPC ..... 52/831, 846, 847, 850, 854, 851, 852; 16/96 R, 87 R; 160/201
See application file for complete search history.

(56) References Cited

U.S. PATENT DOCUMENTS

| | | | | |
|---|---|---|---|---|
| 3,484,812 | A * | 12/1969 | Holland | 160/201 |
| 5,954,111 | A | 9/1999 | Ochoa | |
| 5,992,497 | A * | 11/1999 | Jaehnen et al. | 160/201 |
| 6,073,414 | A * | 6/2000 | Garris et al. | 52/694 |
| 6,088,988 | A * | 7/2000 | Sahramaa | 52/639 |
| 6,227,281 | B1 * | 5/2001 | Martin | 160/201 |
| 6,250,360 | B1 | 6/2001 | Ochoa | |
| 6,415,576 | B1 * | 7/2002 | Stromback | 52/719 |
| 6,467,127 | B1 * | 10/2002 | Goldstein | 16/87 R |
| 6,533,249 | B2 * | 3/2003 | Ochoa | 256/13.1 |
| 6,540,003 | B1 * | 4/2003 | Martin | 160/201 |
| 6,644,888 | B2 * | 11/2003 | Ochoa | 404/6 |
| 7,530,548 | B2 * | 5/2009 | Ochoa | 256/13.1 |
| 8,146,295 | B2 * | 4/2012 | Kibbel et al. | 49/504 |
| 2003/0089069 | A1 * | 5/2003 | Babich et al. | 52/693 |
| 2004/0139684 | A1 * | 7/2004 | Menendez | 52/720.1 |
| 2004/0255543 | A1 * | 12/2004 | Ubilla | 52/720.1 |
| 2005/0066611 | A1 * | 3/2005 | Brady | 52/633 |
| 2005/0081477 | A1 * | 4/2005 | St. Quinton | 52/720.1 |
| 2005/0189079 | A1 * | 9/2005 | Mullet et al. | 160/201 |
| 2005/0205220 | A1 * | 9/2005 | Johnston et al. | 160/201 |

(Continued)

*Primary Examiner* — Katherine Mitchell
*Assistant Examiner* — Johnnie A Shablack
(74) *Attorney, Agent, or Firm* — Thomas I. Rozsa

(57) ABSTRACT

An improvement in garage door tracks which includes placing an inwardly pressed hem on the distal ends of the sections of track which surround the gap by which wheels from a garage door are placed into a track chamber. The hems on the distal end provide increased strength and a safer smoother edge. The inward hemming also does not interfere with the roller wheels of the garage door. This further solves the problem of track failure and bulge or crimping and causes less stress on the garage door track. A further innovation is to have strengthening ribs at different locations on the garage door track to provide further strength to the garage door track. A further innovation is to provide strengthening ribs at different locations on the garage door track to provide further strength to the garage door track.

1 Claim, 7 Drawing Sheets

(56) References Cited

U.S. PATENT DOCUMENTS

2005/0241261 A1* 11/2005 Martinez-Cepeda ..... 52/737.6
2007/0283525 A1* 12/2007 Beaudoin et al. ..... 16/81
2008/0264579 A1* 10/2008 Rauch et al. ..... 160/202
2009/0113846 A1* 5/2009 Knauf ..... 52/846
2009/0126315 A1* 5/2009 Knauf ..... 52/846
2009/0308016 A1* 12/2009 Strickland et al. ..... 52/636
2010/0192465 A1* 8/2010 Hormann et al. ..... 49/73.1
2010/0281821 A1* 11/2010 Frobosilo ..... 52/846
2010/0287872 A1* 11/2010 Bodnar ..... 52/582.1
2012/0067000 A1* 3/2012 Kiilunen ..... 52/653.1
2012/0266562 A1* 10/2012 Woolf ..... 52/846
2014/0165499 A1* 6/2014 Vanker et al. ..... 52/834

* cited by examiner

- Prior Art -

GARAGE DOOR TRACK WITH INWARDLY HEMMED SIDEWALL, AND REINFORCING RIBS TO REDUCE THE INCIDENCE OF ROLLOUT

BACKGROUND OF THE INVENTION

1. Field of the Invention

The present invention relates to the field of tracks installed in garage openings to accommodate the wheels of garage doors and in particular to enable the garage door to be rolled down in a closed position and to also enable the garage door to be rolled up so that it is generally parallel to the garage floor and the garage is opened to permit entry and exit of vehicles or other items in the garage.

2. Description of the Prior Art

In general the concept of improving a garage door track has been performed. In conventional garage door tracks, the exterior edges of the track are sharp which can create a risk of a cut to an installer and a home owner. As illustrated in FIG. 3A, the prior art garage door track 2000 has sharp ends 2100 and 2200 and a reinforcing member 2300 with sharp ends 2400 and 2500.

One improvement is to cause the track edges to be hemmed outwardly. Another variation is to cause the track to be rolled inwardly as described in U.S. Pat. No. 5,954,111. The use is also described in U.S. Pat. No. 6,250,360. In general, the prior art garage door tracks have no stiffening ribs and no mechanism to provide extra support to the track to prevent rollout of the garage door wheels from the track as the garage door is moved upwardly toward the horizontal open position.

There is a significant need for an improved garage door track which addresses the deficiencies of the known prior art garage door tracks.

SUMMARY OF THE INVENTION

In general, the present invention relates to improvements in a track and track support structure for a sectional overhead garage door.

In general, the garage door track is an elongated piece of material such as steel, having an outer section with a wall extending at one end to an interior wall section which in turn extends to an inner section having a wall. In general, the outer section is adjacent a wall of a garage door opening, the interior wall section extends generally perpendicularly to the outer section, and the arcuate inner section is farthest from the garage door wall and is rounded and curves toward the outer section. An opening between a distal end of the outer section and the distal end of the inward curve of the inner section enables the wheels of the garage door to enter and be retained in the track area surrounded by the outer section, the interior wall section and the arcuate inner section.

In the prior art, the distal end of the outer section and the distal end of the inward curve of the outer section are sharp. Attempts to reduce the sharp ends have been made by hemming the distal ends outwardly from the track interior against an outer wall of the outer section and forming a hemmed edge and extending against an outer wall of the inward curve of the inner section. Other attempts to reduce the sharp ends were to create interior roll formed beads. However, to achieve this the material needs to be very thin which reduced the strength of the track and the garage door wheels would bind on the interior roll formed beads.

Hemming is bending in the sharp edges of the track either outwardly so that the edges are bent against adjacent outer walls of the track or bent inwardly so that the edges are bent against adjacent inner walls of the track. It has been discovered, according to the present invention, that if the outermost distal edge portions of the track which include the distal end of the outer section and the distal end of the inward curve of the arcuate inner section are respectively hemmed and bent inwardly against an adjacent inner wall section of the outer section and against an adjacent inner wall of the inwardly curved portion of the arcuate inner section, then hemming the edge of the garage door track inwardly provides increased strength and a safer smooth edge. The inward hemming will also not interfere with the roller wheels of the garage door. The entire track section has a common exterior wall and a common interior wall.

It has been discovered, according to the present invention, that hemming the edge of the garage door track inwardly provides increased strength and a safer smoother edge. An inside hemmed edge will provide a means of door roller retention with increased strength of the inward hemmed edge. This solves the problem associated with conventional garage door tracks, including: (a) edge imperfections of a steel edge which can lead to track failure; (b) an edge imperfection could be a bulge, crimp or edge stress concentration; (c) at the blade edge of the steel, edge buckling can lead to failure of the door.

It has further been discovered, according to the present invention, that a hemmed edge will provide increased resistance to track bowing. The hemmed edge solves the problem associated with sharp edges. Sharp edges can cut hands or fingers during installation of the garage door into the track or throughout its service life. The stronger design can now be now be produced in a reduced steel thickness without sacrificing the strength and integrity of the track. This also facilitates a reduced cost unit rate and a single thickness for all residential tracks. This reduces inventory for even more reduced costs of manufacturing.

It has further been discovered, according to the present invention, that the addition of stiffening ribs into the outer section, interior inner wall, and adjacent the arcuate inner section of the track increases strength rigidity and reduces track bowing and track roll out. Track roll out is used to describe the fallout and failure of the door and door rollers. In the present invention, four stiffening ribs have been incorporated into the garage door tracks. A first stiffening rib is formed on the top sidewall of the outer track section. Two spaced apart stiffening ribs are formed on the interior sidewall section, and a fourth spaced apart stiffening rib is formed in the wall of the curl section which is the portion of the interior sidewall that curves into the arcuate inner section of the track. These roll formed channels or stiffening ribs will provide increased strength to the entire track set. These channels combined with the hemmed inward edge provide increased strength on the entire track set which would take 30-40% thicker steel to achieve the same strength, providing a weight savings of at least 30%. This in turn saves cost per set in the manufacturing. This increased strength will allow the manufacturer to run one gauge (thickness) of steel, thereby eliminating the need for multiple gauges. One gauge can now be used for light duty to heavier duty residential applications by only changing the reinforcing angle. The lower cost to the manufacturer is passed on to the user/dealer and reduced inventory cost.

It has been discovered, according to the present invention, that the addition of the top stiffening rib not only increases strength, but also provides a channel and space/area for the door rollers to ride up in. This is while the door is traveling to the raised position. Without the top stiffening rib, roller drag occurs. This is a problem with 10 inch, 12 inch and 15 inch radius track. Carriage house style doors that are 3 sections tall with 28 inch oversize sections and larger 32 inch sections have the same roller drag problem. While the door is rolling up through the radius on the top of the track, the door rollers get forced against the top of the track. This causes roller drag (binding/friction). Roller drag causes extra wear on the hinges, rollers, door sections and garage door operators. The top stiffening rib channel solves this problem. The extra space/area allows the roller to rise/raise into the channel (rib) allowing it to turn freely with no binding and dragging. This provides smooth door action throughout the entire radius transition. It works almost the same way in the down cycle. As the garage operator pushes the door through the radius position, the door is pushed against the front of the track in the vertical position. The stiffening rib channel provides the extra space to move the rollers forward and not bind in the radius. This results in a big improvement in smooth bind free performance, providing extra life for door parts including cost effective performance at no extra cost and extra strength for the life of the door track.

Another improvement is a reinforcing angle which matches the ribs on the section of the track which is the top horizontal section of track parallel to the floor. The reinforcing angle provides extra supporting strength to the horizontal track portion by having strengthening ribs which match the strengthening ribs of the track section. A reinforcing angle for the garage door track has been straight cut and has had a sharp edge since it was invented. This sharp edge has a sharp point. This has caused injury to installers and homeowners for years. Having a radius curved edge will eliminate the sharp point and provide a safer edge. There is no added cost and no loss of strength but it provides a substantial improvement over the prior art straight cut tracks for garage doors.

It should be noted that the reinforcing angle that have no stiffening ribs [industry standard design] Prior art drawing FIG. 3A would have to be 0.075 thick [14 Ga steel] To provide the same strength as the 0.065 [16 Ga steel] reinforcing angle with the present invention. This provides significant savings in the cost of the part. The reduced weight savings in addition to the cost of part savings, would reduce shipping costs. Less weight equals more product per truckload reducing shipping and the final cost of each Track set. Plus radius cut safer edge provides added safety and easy handling of completed track set with no added costs to manufacturing.

It has further been discovered, according to the present invention, that a shorter length on the horizontal section of the track rail section will make the track stronger by reducing unsupported span. Most prior art horizontal garage door track sections are 8 feet 6 inches for a 7 foot door; or 9 feet 6 inches for an 8 foot door. Reducing the horizontal track length by 12 inches it moves the point of support (back hang) closer to the top roller of the door. The distance from the back-hang to the top roller is considered unsupported span. Unsupported span tends to let the track twist and bow. This could lead to track roll out or failure. The door roller on the top could fall out of the rack because of the bow/twist. Some prior art involves extra holes in the track. The holes are used to move the back hang forward which looks odd and unsightly. Shortening the horizontal track provides and facilitates the strongest back hang.

Sometimes the vertical section of the garage door track is damaged by the owner hitting it with his car. The present invention can be used to replace only the vertical part and inter-fit with the remainder of the existing undamaged track, even if does not have the improvements in the track as described above.

The objects of the present invention are to incorporate into a garage door track all of the discoveries and improvements as set forth above.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF THE PREFERRED EMBODIMENTS

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Figure 1:
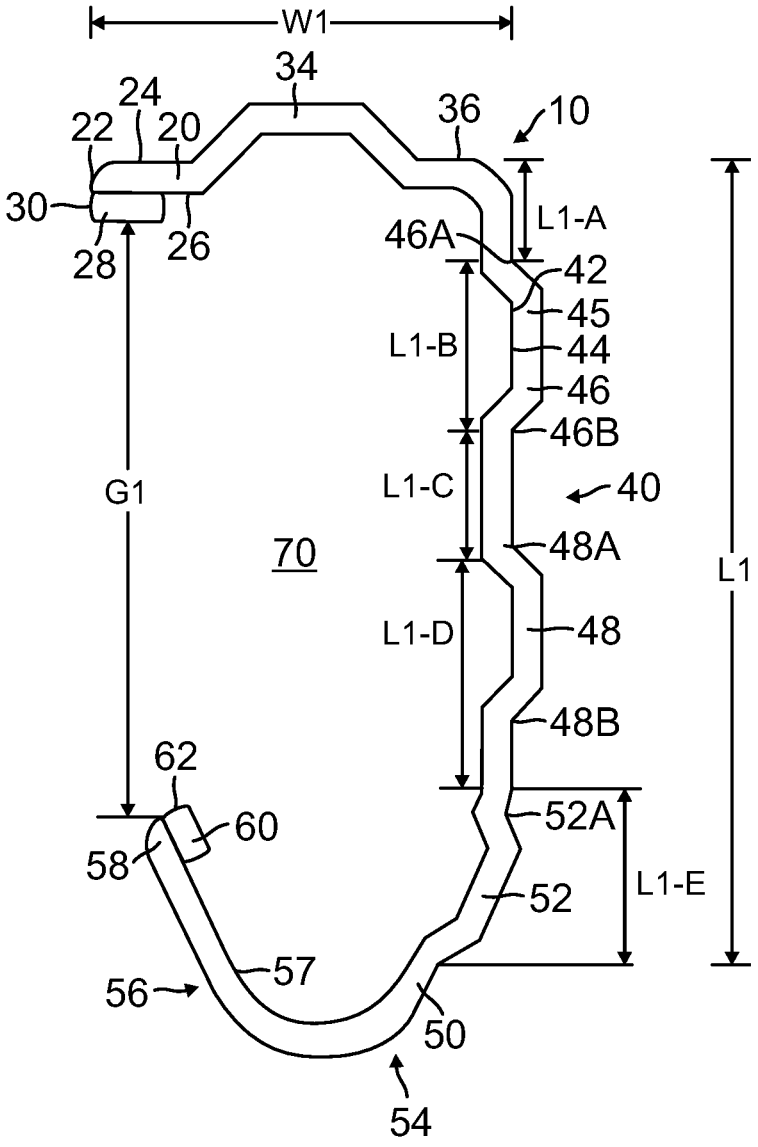
FIG. 1 is an end view of the present invention garage door track illustrating a first stiffening rib of the top sidewall of the outer track section placed closest to a garage door wall when installed, two spaced apart stiffening ribs on the interior sidewall when installed, and a fourth spaced apart stiffening rib in the wall of the curl section which is the portion of the interior sidewall that curves into the arcuate inner section of the track, the arcuate inner section being farthest away from a garage door wall when installed and having a curved section extending to an inward curving section closest to the outer wall section, leaving a gap into which roller wheels from a garage door are inserted.

Referring to FIG. 1, there is illustrated an end view of the present invention garage door track 10, illustrating two of the major improvements of the present invention. The garage door track 10 comprises an outer wall section 20 having a distal end 22, an exterior wall 24 and an interior wall 26, with one of the innovations being that at the distal end 22, the garage door track is hemmed inwardly with the inward first hem 28 having a round exterior end 30 and pressed parallel to and against an adjacent section of the interior wall 26. A second innovation is that the outer section wall 32 bounded by interior wall 26 and exterior wall 24 has a strengthening rib 34 formed into it and centrally disposed along the width "W1" of the outer wall section 20, the strengthening rib 34 extending outwardly away from an interior chamber 70 to be described.

The outer wall section 20 extends at its proximal end 36 to an interior side wall section 40 having a wall 42 bounded by an interior wall 44 and an exterior wall 45 with a second strengthening rib 46 formed into wall 42 and extending away from the interior chamber 70. The interior side wall section 40 has a spaced apart third strengthening rib 48 formed into wall 42 and extending away from the interior chamber 70. The interior side wall section 40 extends to a curl portion 50 which is still part of wall 42 and bounded by interior wall 44 and exterior wall 45 with a fourth strengthening rib 52 formed into wall 42 and extending away from chamber 70. Second strengthening rib 46 is spaced apart from third strengthening rib 48. The length "L1" is from the proximal end of exterior wall section 20 where it joins interior side wall section 40 to adjacent the distal end of fourth strengthening rib 52. The section distance "L1-A" extends from the proximal end 36 to first space 46A of second strengthening rib 46 and a distance "L1-B" extends from a first space 46A of second strengthening rib 46 to a second space 46B of second strengthening rib 46. A length "L1-C" extends from a second space 46B of the second strengthening rib 46 to a first space 48A of third strengthening rib 48. The third strengthening rib 48 has a distance "L1-D" extending from 48A to 48B and the fourth strengthening rib 52 has a distance "L1-E", with distances "L1-A", "L1-B", "L1-C", "L1-D" and "L1-E" combining to be "L1". Curl portion 50 extends to arcuate inner section 54 which extends to an inward curved portion 56 terminating in a distal end 58 of arcuate inner section 54 I which is hemmed inwardly with second hem section 60 pressed against interior wall 57 and having a rounded end 62. A gap "G1" is between first hem section 28 and second hem second 60 leading interior chamber 70 bounded by outer section 20, interior side wall section 40 and arcuate inner section 54 so that wheels of a garage door can be inserted through the gap "G1" and into chamber 70.

Figure 2:
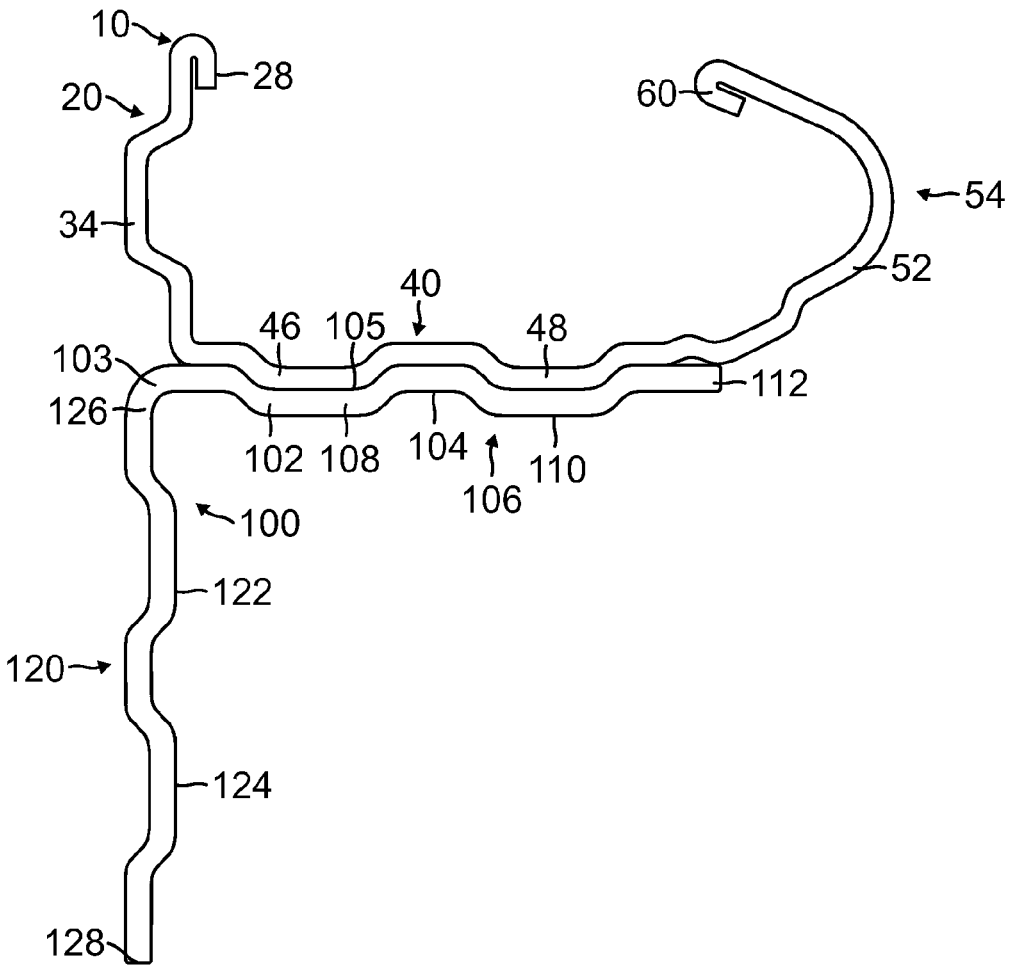
FIG. 2 is an end view of the present invention garage door track when viewed from a horizontal section of track including a matching reinforcing angle with a section affixed to the interior sidewall of the garage door track and a second portion hanging in the air.
Figure 3A:
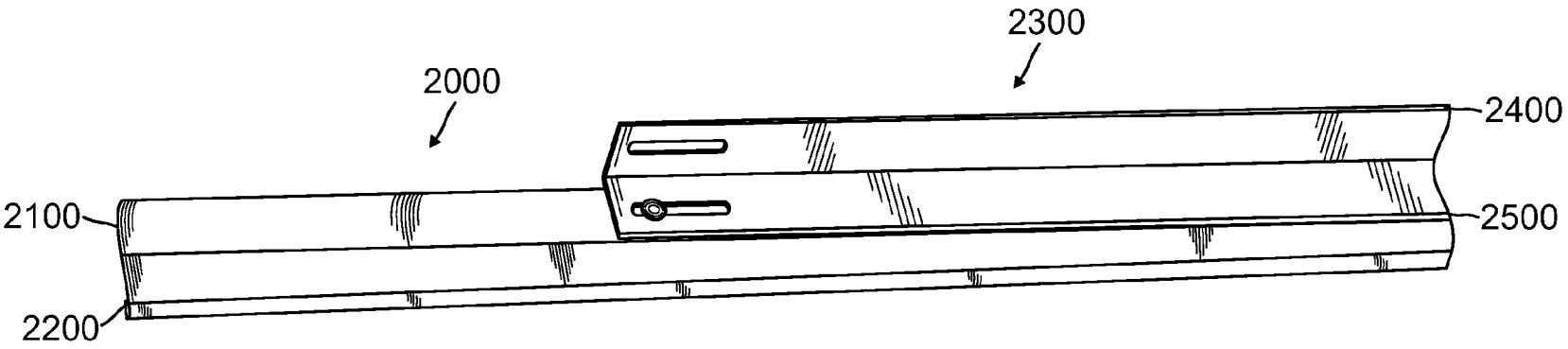
FIG. 3A is a side perspective view of a prior art garage track with a straight wall having no strengthening ribs and a straight reinforcing angle, the track and reinforcing angle having sharp exterior ends to their respective walls.
Figure 3B:
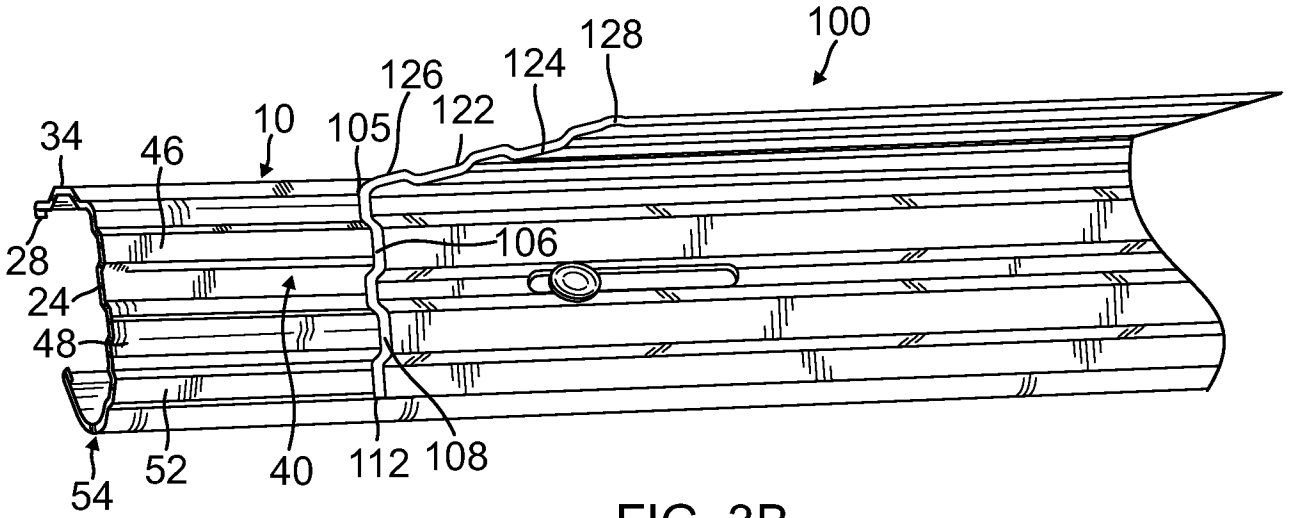
FIG. 3B is a perspective view of the combination garage door track including a matching reinforcing angle with a section affixed to the interior sidewall of the garage door track and a second portion hanging in the air.
Figure 4:
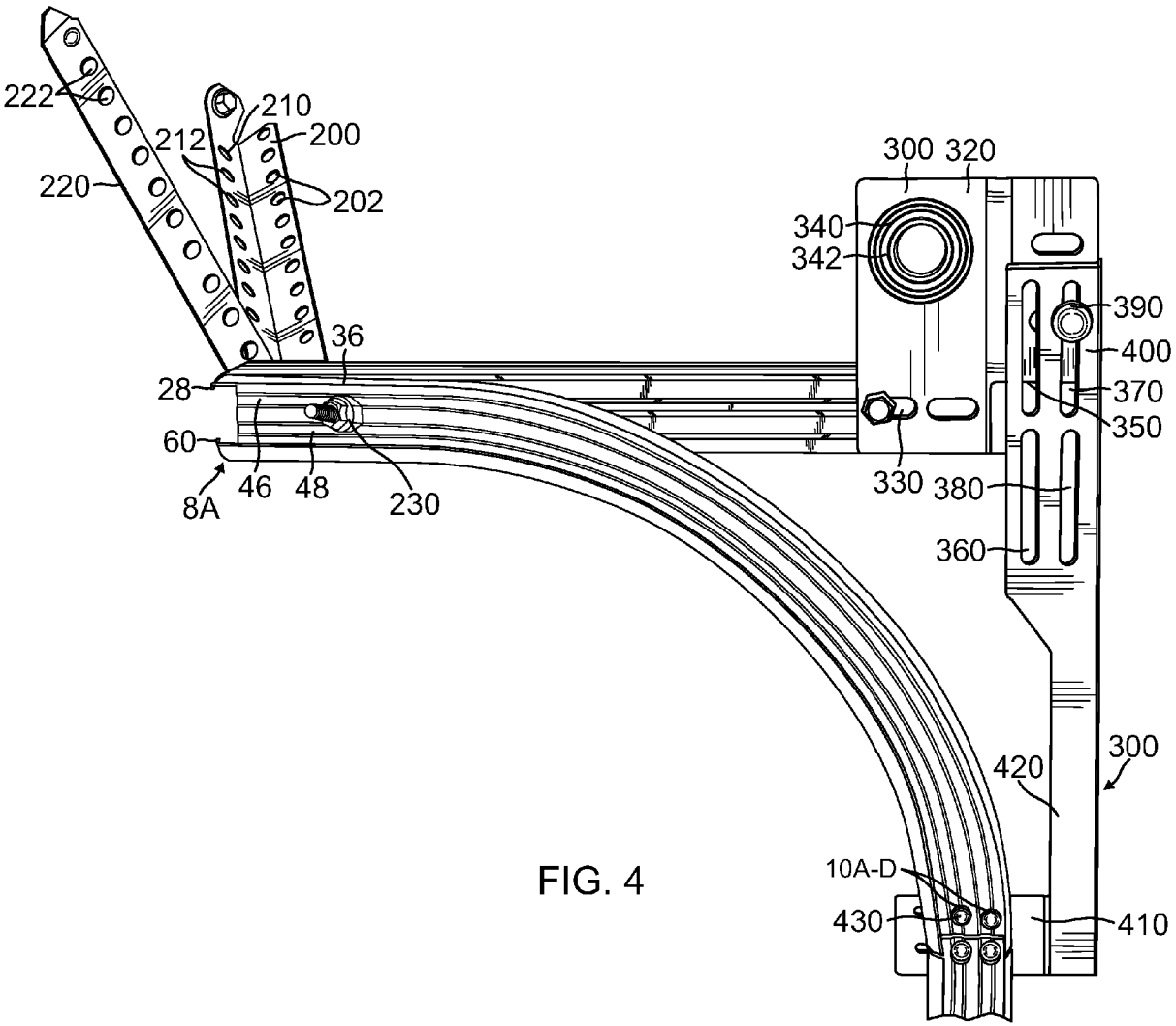
FIG. 4 is a front perspective view of the present invention garage door track with backing members used to affix the distal end of the garage door track to a garage ceiling, also illustrating a stop bolt to prevent the garage door wheels from rolling out of the track, also illustrating a rear view of the matching reinforcing angle and illustrating a flag bracket retaining the garage door track at the location where the garage door track extends from a horizontal section to a vertical section and illustrating a return spring member to assist in raising the garage door.

Referring to FIG. 2, there is illustrated the present invention garage door track with hemmed distal ends and four strengthening ribs and an additional innovation of a reinforcing angle 100 having a wall 102 with an interior 104 and an exterior 105. The reinforcing angle 100 has a first section 106 having a first strengthening rib 108 and a spaced apart second strengthening rib 110 which are formed to match second strengthening rib 46 and third strengthening rib 48 of interior side wall section 40 and spaced apart so that the strengthening ribs 46 and 108 are aligned and strengthening ribs 48 and 110 are aligned, with the distal end 112 of the first section of the reinforcing angle 100 terminating adjacent the fourth strengthening rib 52. As best illustrated in FIG. 3B, the reinforcing angle 100 is slidably affixed at a location of the rear wall 24 of the interior side wall section 40 of track section 10 by an affixation member 114 which extends through an oval opening 116 in first section 106 of reinforcing angle 100 and a corresponding opening in section 40 of track 10 so that the location of the reinforcing angle 100 can be adjusted. As illustrated in FIG. 4, all respective reinforcing ribs run the length of the track and the length of the reinforcing angle.

As illustrated in FIG. 2 and FIG. 3B, the reinforcing angle 100 has a second section 120 which is generally perpendicular to the first section 106 at its proximal end 103 and extends away freely in the air. The second section 120 of the reinforcing angle 100 also has strengthening ribs 122 and 124 between its proximal end 126 adjacent proximal end 103 and the distal end 128 of the second section 120 of reinforcing angle 100 which further strengthens the track. The edge of the reinforcing angle 100 has a radius to prevent a sharp edge cut to an installer or homeowner.

Figure 5:
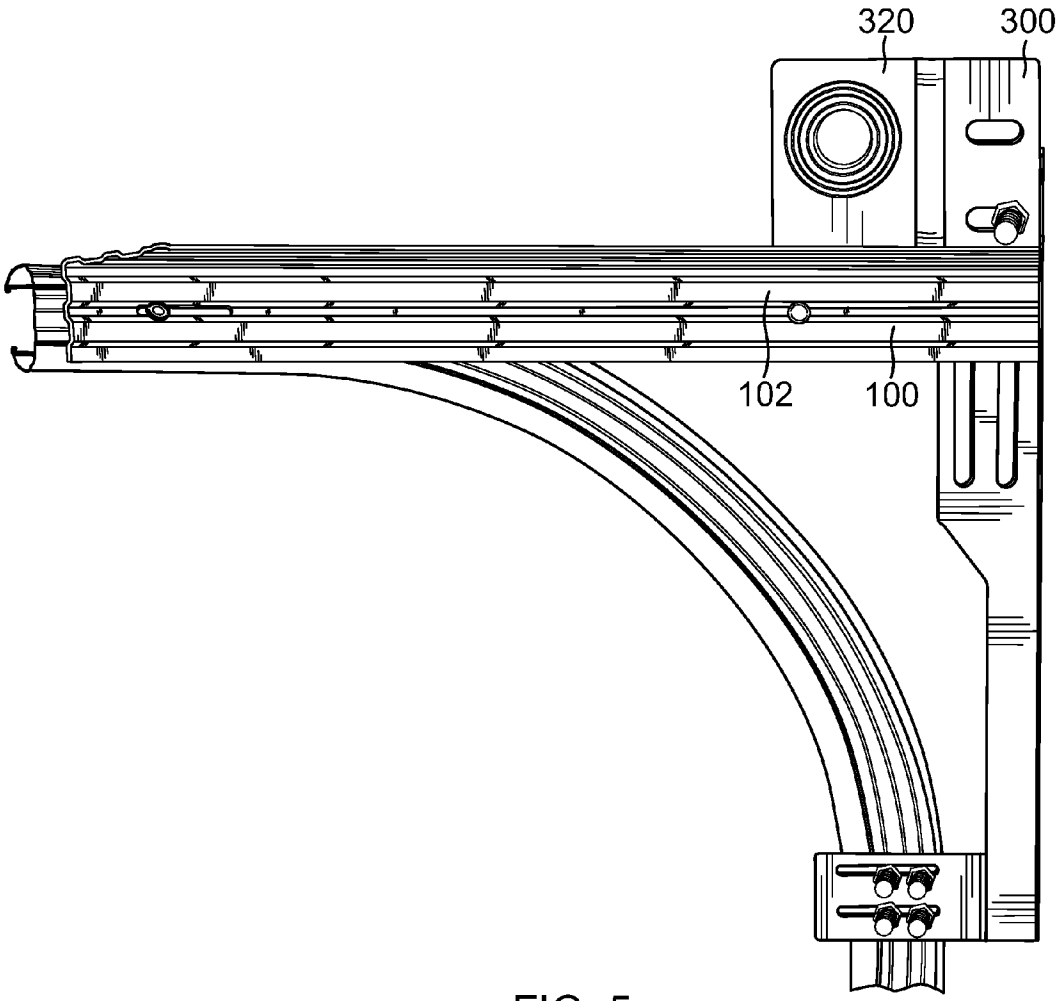
FIG. 5 is a rear perspective view of the present invention garage door track illustrated in FIG. 4.

Referring to FIG. 4, there is illustrated a front perspective view of a completed track section and supporting members for the section of track 10A which extends in a horizontal direction to receive the rollers of a garage door when the garage door is rolled up so that it is generally parallel to the garage door floor when the garage is open. FIG. 5 is a rear perspective view of most of the embodiment illustrated in FIG. 4.

The rear track section 10A has the same innovations of the hemmed ends 28 and 60 and supporting ribs 34, 46, 48 and 52. Adjacent the distal rear end 8A of horizontal track section 10A at a distance beyond the reinforcing angle section 106 of reinforcing angle 100 and affixed to the back of track section 10A are backing members 200 having a multiplicity of openings 202, 210 having a multiplicity of openings 212 and 220 having a multiplicity of openings 222. The rear track section 10A is affixed to a ceiling of a garage by affixation members such as one way bolts or one way screws respectively extending through one or more of the multiplicity of openings 202, 212 and 222 of the respective backing members 200, 210 and 220. A stop bolt 230 extends through an opening in the back wall 24 of interior side wall section 40 of the track section 10A adjacent the distal end 8A and extends into opening 70 to prevent the wheels of the door from moving past the distal end 8A and off the track 10A.

The angle support 100 is only on the horizontal portion of the track 10A and supports only a portion of the track section 10A. A flag bracket 300 is mounted to the garage wall. The flag bracket 300 has a first section 320 with mounting members 330 affixed to an extended portion of the reinforcing angle 100 with a coiling spring member 340 having a coil 342 to help raise the garage door. The flag bracket 300 has a multiplicity of slotted openings 350, 360, 370 and 380 to adjustably mount the distal end 102 of the reinforcing angle 100 to one or more affixation members 390 such as mounting bolts which extend through the proximal section 400.

The track section 10A extends from its horizontal position around a curved section before it is joined to a vertical section 10B of track 10. A flag 410 located at a distal end 420 of the flag bracket 300 has mounting members 430 which affix the flag 410 to the distal end 10A-D of track section 10A. The flag 410 also has mounting members 440 which affix the flag 410 at an upper or distal end 10B-D of vertical track section 10B. In this way, the track sections 10A and 10B of track 10 are supported.

Another innovation of the present invention is to reduce the distance from the distal end 8A to distal end 10A-D of horizontal track section 10A by 12 inches. This section is known as unsupported span covering the distance from the back hangers 200, 210 and 220 to distal end 10A-D. In the prior art, the span of 8 feet 6 inches or more enables the track section 10A to twist and bow leading to track roll out. The reduction of span length to 7 feet 6 inches for a 7 foot tall door (or reduction to 8 feet 6 inches for a eight foot tall door) provides for a much stronger unsupported span reducing the track twisting and bowing and reducing the incidence of rack roll out.

Figure 6:
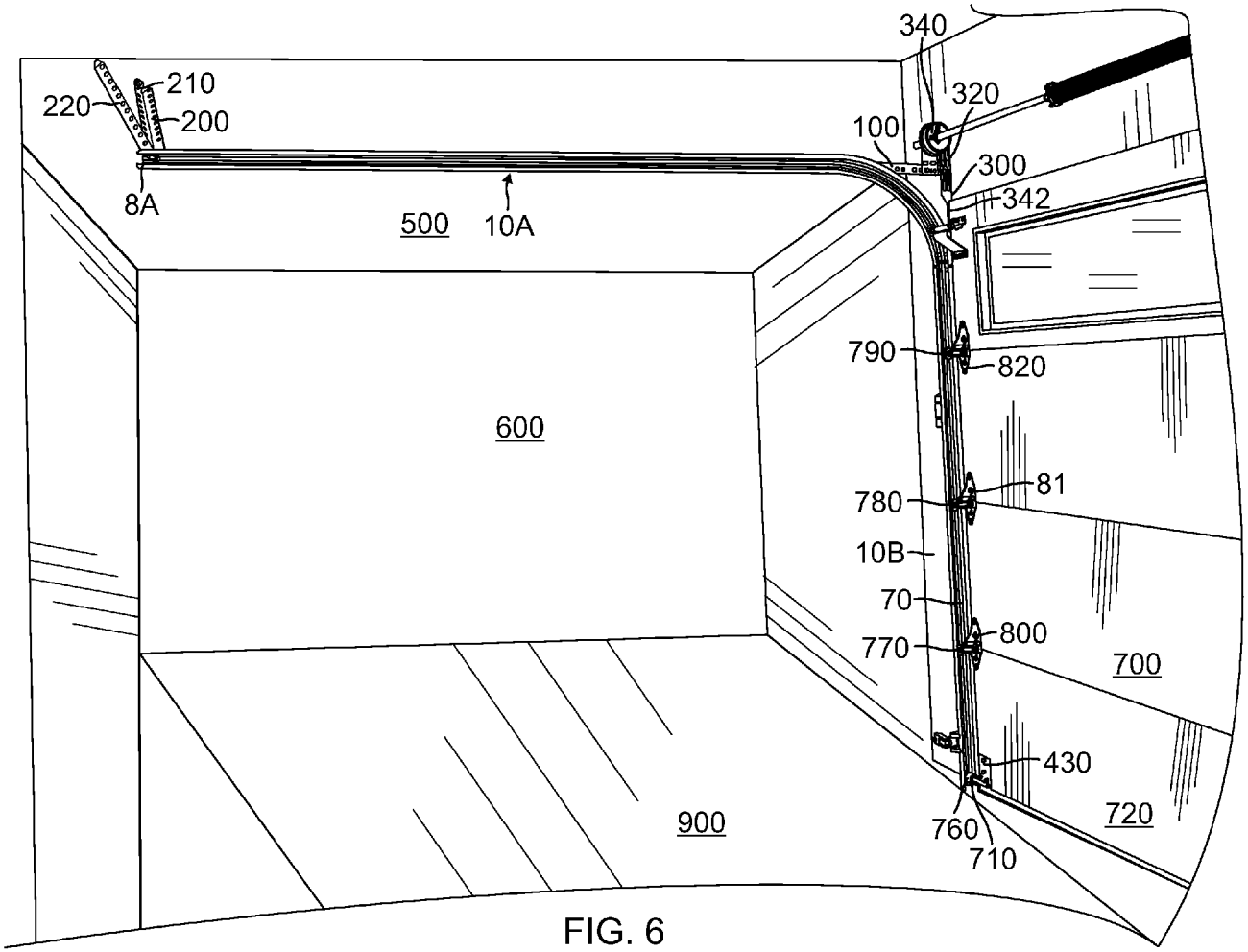
FIG. 6 is a perspective view when standing in a garage with the garage door down, the right side of the garage door wheels inserted into a right vertical right section of track, which vertical right section of track extends onto and is affixed to a portion of the ceiling of the garage.

Referring to FIG. 6, there is illustrated a view standing inside a garage with the garage door viewed from a rear view in the down condition with the right side of the garage door wheels inside the right vertical section of track and the horizontal section of track extending around a curve and mounted to the ceiling of the garage on the right side of the garage door track structure. The rear track section 10A which is horizontal is adjacent the ceiling 500 of garage 600 with the backing members 200, 210 and 220 with their respective affixation members extending through respective openings 202, 212, into the ceiling 500 with the backing members illustrated adjacent the distal end 8A of the horizontal track section 10A of track 10. The flag bracket 300 is mounted to the upper interior garage wall 550 with its first section 320 affixed to an extended portion of the enforcing angle 100 with the coil spring member 340 having a coil 342 affixed to the bottom 710 of the garage door 700 to help raise the garage door 700. The enforcing angle 100 is only against the horizontal section 10A of the track 10. The back 24 of the lowermost portion of the vertical track section 10B of track 10 is affixed to flag bracket 430 which is affixed to the back 720 of the garage door 700. Mounting brackets 800, 810 and 820 further affix the vertical track section 10B to respective locations along the vertical distance of the back of the garage door 720. Garage door wheels 760, 770, 780 and 790 are illustrated inserted into chamber 70 along respective locations along respective vertical locations of the vertical track section. The wheels 760, 770, 780 and 790 are affixed to a side of the garage door 700. It will be appreciated that the left track 10 and its vertical and horizontal track sections are a mirror image of the right track section illustrated in FIG. 6 with wheels affixed onto the left side of the garage door inserted into a corresponding chamber in a left track section.

The wheels of the garage door ride on the vertical track sections until they arrive at the horizontal track sections so that the garage door is horizontal adjacent the ceiling 700 and generally parallel to the floor 900. The garage door 700 is rolled down the vertical track sections to close the garage.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

What is claimed is:

1. A garage door track (10) used in conjunction with a vertical side wall and ceiling of a garage, the garage door track (10) comprising:

a. a first vertical track member (10) having an outer wall section (20) having a distal end (22) with an interior wall (26) and an exterior wall (24), the distal end (22) of the outer wall section (20) of the garage door track (10) is hemmed inwardly with an inward first hem (28) having a rounded exterior end (30) and pressed parallel to and against an adjacent section of the interior wall (26), a first strengthening rib (34) formed into the outer wall section (20), the strengthening rib (34) extending outward away from an interior chamber (70);

b. the outer wall section (20) extending at a proximal end (36) to an interior side wall section (40) having a wall (42) bounded by an interior wall (44) and an exterior wall (45) with a second strengthening rib (46) formed into the wall (42) and extending away from the interior chamber (70), the interior side wall section (40) having a spaced apart third strengthening rib (48) formed into the wall (42) and extending away from the interior chamber (70), the interior side wall section (40) extending to a curled portion (50) which is part of wall (42) and bounded by interior wall (44) and exterior wall (45), a fourth strengthening rib (52) formed into the wall (42) and extending away from interior chamber (70), second strengthening rib (46) spaced apart from a third strengthening rib (48), a third strengthening rib (48) extending a given distance away from a second strengthening rib (46) and a fourth strengthening rib (52), the curl portion (50) extending to an arcuate inner section (54) which extends to an inward curved portion (56) terminating in a distal end (58) of arcuate inner section (54) inwardly forming a second hem section (60) pressed against interior wall (57) of curl portion (50) and having a rounded end (62), a gap (G1) formed between first hem section (28) and second hem second (60) leading into interior chamber (70) bounded by outer wall section (20), interior side wall section (40) and arcuate inner section (54) so that wheels of a garage door can be inserted through a gap (G1) into chamber (70);

c. a reinforcing angle (100) having a wall (102) with an interior (104) and an exterior (105), the reinforcing angle (100) having a first section (106) having a first strengthening rib (108) and a spaced apart second strengthening rib (110) which are formed to match second strengthening rib (46) and third strengthening rib (48) of interior side wall section (40) and spaced apart so that the strengthening ribs (46) and (108) are aligned and strengthening ribs (48) and (110) are aligned, with the distal end (112) of the first section (106) of the reinforcing angle (100) terminating adjacent the fourth strengthening rib (52), the reinforcing angle (100) slidably affixed at a location of the exterior wall (24) of the interior side wall section (40) of track section (10) by an affixation member (114) which extends through an oval opening (116) in the first section (106) at its proximal end (103) and extending away, the second section (12) of the reinforcing angle (100) also having strengthening ribs (122) and (124) between its proximal end (126) adjacent proximal end (103) and the distal end (128) of the second section (120) or reinforcing angle (100) further strengthening the track, the edge of the reinforcing angle (100) having a radius to prevent a sharp edge cut;

d. rear track section (10A) having hemmed ends (28) and (60) and supporting ribs (34), (46), (48) and (52), adjacent the distal rear end (8A) of horizontal track section (10A) at a distance beyond the reinforcing angle section (106) of reinforcing angle (100) and affixed to the back of track section (10A) are backing members (200) having a multiplicity of openings (202), (210) having a multiplicity of openings (212) and (220) having a multiplicity of openings (222), the rear track section 10A affixed to a ceiling of a garage by affixation members extending through a multiplicity of openings (202), (212) and (222) of the respective backing members (200), (210) and (220), a stop bolt (230) extending through an opening in the back wall 24 of interior side wall section (40) of the track section (10A) adjacent the distal end (8A) and extending into chamber (70) to prevent wheels of a door from moving at a distal end 8A and off the track 10A;

e. a flag bracket (300) mounted to a garage door wall, the flag bracket (300) having a first section (320) with mounting members (330) affixed to an extended portion of the reinforcing angle (100) with a coiling spring member (340) having a coil (342) to help raise the garage door, the flag bracket (300) having a multiplicity of slotted openings (350), (360), (370) and (380) to adjustably mount the distal end (102) of the reinforcing angle (100) to one or more affixation members (390) which extend through the proximal section (400); and f. track section (10A) extending from a horizontal position around a curved section before it is joined to a vertical section (10B) of track (10), a flag (410) located at a distal end (420) of the flag bracket (300) has mounting members (430) which affix the flag (410) to the distal end (10A-D) of track section (10A), the flag (410) also having mounting members (440) which affix the flag (410) at an upper or distal end (10B-D) of vertical track section (10B) so that the track sections (10A) and (10B) of track (10) are supported;

g. whereby, a distance from a distal end (8A) to a distal end (10A-D) of horizontal track section (10A) is reduced by 12 inches, which is an unsupported span covering a distance from backing members (200), (210) and (220) to distal end (10A-D), thereby providing a much stronger unsupported span reducing track twisting and turning and bowing and reducing incidence of track rollout.

* * * * *